US008720462B2

(12) United States Patent
Vieira et al.

(10) Patent No.: US 8,720,462 B2
(45) Date of Patent: May 13, 2014

(54) APPARATUS CONFIGURED TO MANIPULATE A TARPAULIN

(75) Inventors: Michael C. Vieira, Fall River, MA (US); James Adamson, Norwell, MA (US)

(73) Assignee: Monahan Products, LLC, Hingham, MA (US)

( * ) Notice: Subject to any disclaimer, the term of this patent is extended or adjusted under 35 U.S.C. 154(b) by 276 days.

(21) Appl. No.: 13/182,962

(22) Filed: Jul. 14, 2011

(65) Prior Publication Data

US 2013/0017055 A1 Jan. 17, 2013

(51) Int. Cl.
*E04H 15/62* (2006.01)
*A45F 5/10* (2006.01)

(52) U.S. Cl.
CPC . *E04H 15/62* (2013.01); *A45F 5/10* (2013.01)
USPC ..... 135/118; 135/95; 383/4; 383/124; 294/152

(58) Field of Classification Search
CPC ..... E04H 15/30; E04H 15/32; E04H 15/62; E04H 15/64; A47G 9/06; A47G 9/062; B65G 7/00; B65G 7/12; A45F 4/02; A45F 4/04; A45F 5/10; A45F 5/1026; B65D 33/00; B65D 33/06; B65D 33/246
USPC ..... 383/4, 6, 22–24, 127; 135/118, 119, 135/120.4, 95, 905; 5/414–420; 294/152, 294/164, 170–171; 24/302, 599.1, 599.4, 24/598.2, 369, 370, 372; 16/114.1, 405, 16/406, 443–444, 422, 428
See application file for complete search history.

(56) References Cited

U.S. PATENT DOCUMENTS

| | | | | |
|---|---|---|---|---|
| 5,104,133 | A * | 4/1992 | Reiner | 280/19 |
| 5,529,321 | A * | 6/1996 | Thompson | 280/19 |
| 5,564,232 | A | 10/1996 | Callaway | |
| 5,666,678 | A * | 9/1997 | Wall | 5/417 |
| 5,732,662 | A * | 3/1998 | Jacobsen | 119/798 |
| 5,943,831 | A | 8/1999 | Pangburn | |
| 6,799,593 | B2 * | 10/2004 | Kendro, Jr. | 135/95 |
| 7,082,954 | B1 * | 8/2006 | Flanery et al. | 135/118 |
| 7,785,008 | B2 * | 8/2010 | Schoenig et al. | 383/4 |
| 8,016,335 | B2 * | 9/2011 | McKay | 294/152 |
| 8,146,183 | B2 * | 4/2012 | Nirmel | 5/417 |
| 8,152,704 | B2 * | 4/2012 | Brice et al. | 482/129 |
| 2009/0183347 | A1 * | 7/2009 | Abels | 24/599.6 |
| 2009/0314321 | A1 * | 12/2009 | Van Dyken | 135/95 |
| 2012/0018428 | A1 * | 1/2012 | Norman | 220/6 |

* cited by examiner

*Primary Examiner* — Winnie Yip
(74) *Attorney, Agent, or Firm* — Lando & Anastasi, LLP

(57) ABSTRACT

Disclosed herein are embodiments of an apparatus for use in securing or transporting a tarpaulin or other sheet of material. The apparatus may include a body, a securing device configured to secure the apparatus to the ground, a connecting member mechanically coupling the securing device to the body, a handle mechanically coupled to the body, and a joining device configured to removably join the apparatus to an object.

22 Claims, 5 Drawing Sheets

APPARATUS CONFIGURED TO MANIPULATE A TARPAULIN

BACKGROUND

Aspects and embodiments of the present disclosure are directed generally to apparatus and methods for securing tarpaulins, sheets, and related objects to a surface, such as to the ground, and to apparatus and methods for moving or hauling such objects.

SUMMARY

In accordance with an aspect of the present disclosure, there is provided an apparatus comprising a body, a handle coupled to one end of the body, and a joining device coupled to an opposite end of the body and configured to removably join the apparatus to an object.

In some embodiments, the apparatus further comprises a securing device configured to secure the apparatus to the ground. In some embodiments, the securing device comprises a spike.

In some embodiments, the apparatus further comprises a connecting member mechanically coupling the securing device to the body. In some embodiments, the connecting member comprises a length of fabric. In some embodiments, the length of fabric comprises nylon webbing.

In some embodiments, the joining device comprises a carabiner.

In some embodiments, the body comprises a length of fabric. In some embodiments, the length of fabric comprises nylon webbing.

In some embodiments, the handle is mechanically coupled to the body by a portion of the length of fabric passed through an orifice in the handle. In some embodiments, the portion of the length of fabric comprises a loop of material secured to the body.

In some embodiments, the joining device is configured to removably join the apparatus to the object by passing through one of a loop and an opening in the object.

In accordance with another aspect of the present disclosure, there is provided kit comprising a sheet including at least one of a loop and an opening and an apparatus including a body, a handle mechanically coupled to the body, and a joining device configured to removably join the apparatus to the sheet.

In some embodiments, the kit further comprises a securing device configured to secure the apparatus to the ground.

In some embodiments, the kit further comprises a connecting member mechanically coupling the securing device to the body.

In some embodiments, the sheet comprises a tarpaulin.

In some embodiments, the opening comprises a grommet.

In some embodiments, the tarpaulin is configured to form a tent.

In accordance with another aspect of the present disclosure, there is provided method comprising providing a tarpaulin including one of a loop and an opening. The method further comprises providing an apparatus including a body, a securing device configured to secure the apparatus to the ground, a connecting member mechanically coupling the securing device to the body, a handle mechanically coupled to the body, and a joining device configured to removably join the apparatus to the tarpaulin. The method further comprises passing a portion of the joining device through the at least one of the loop and the opening, securing the joining device in the at least one of the loop and the opening, and embedding a portion of the securing device in the ground.

In some embodiments, the method further comprises placing an amount of debris on a surface of the tarpaulin.

In some embodiments, the method further comprises transporting the debris placed on the tarpaulin by applying a force to the handle.

In some embodiments, the method further comprises passing the portion of the joining device through at least one of a second loop and a second opening in the tarpaulin and securing the portion of the joining device through the at least one of the second loop and the second opening prior to transporting the debris placed on the tarpaulin.

In some embodiments, the method further comprises configuring the tarpaulin into a portion of a tent.

In accordance with another aspect of the present disclosure, there is provided method of moving yard waste. The method comprises staking a tarp having a sheet and at least one opening in the sheet with an apparatus having a body, a handle coupled to one end of the body, and a joining device coupled to an opposite end of the body and configured to removably join the apparatus to the tarp, depositing yard waste on the tarp, and moving the tarp with the apparatus.

In some embodiments, the tarp comprises a plurality of the at least one opening and the method further comprises coupling the joining device to the plurality of the at least one opening subsequent to depositing the yard waste on the tarp.

In some embodiments, coupling the joining device to the plurality of the at least one opening comprises facilitating retaining the yard waste on the tarp by forming a pocket from the tarp within which the yard waste is enclosed.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
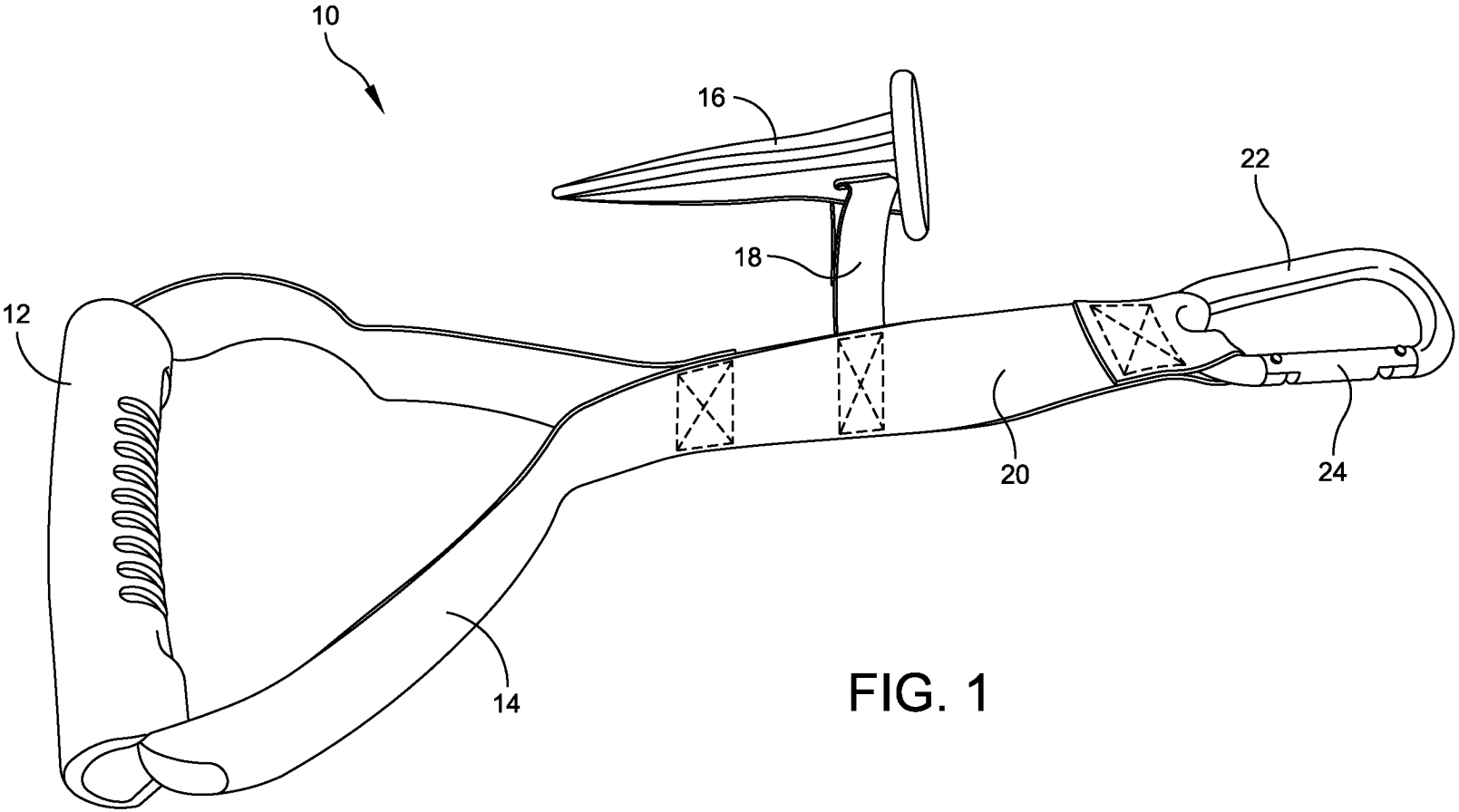
FIG. 1 is a perspective view of an apparatus of an embodiment of the present disclosure.

This disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional items.

Tarpaulins (also referred to herein as "tarps" or "sheets") may be utilized in the performance of various activities, for example, in the removal of debris such as leaves, grass clippings, sticks, and the like from a location such as a yard during cleaning of the yard or after generating debris while performing landscaping activities. Tarpaulins or sheets of canvas may also be used to form shelters, for example, tents for camping outdoors. Tarpaulins may also be used as protective covers for items such as vehicles or firewood, which enables the outside storage of items to protect them from rain, snow, and/or flying debris. Tarpaulins may also be utilized for numerous other purposes which will not be described herein.

In the performance of various activities involving a tarpaulin or sheet of material, it may be desirable to secure at least a portion of the tarpaulin or sheet to the ground. For example, to facilitate raking or blowing leaves or other yard debris onto a tarpaulin it may be desirable to secure one or more edges of the tarpaulin to the ground to maintain the tarpaulin in place and to reduce the amount of leaves or other yard debris that may make its way underneath rather than onto the tarpaulin. Similarly, if a tarpaulin or other sheet of material is used as a tent or a covering from an item, it may be desirable to secure the tarpaulin or other sheet of material in place to reduce the likelihood that the tarpaulin or sheet could blow away or collapse under the influence of wind, rain, or snow.

In some embodiments, a tarpaulin or other sheet may be provided with one or more loops of material and/or openings formed in one or more portions thereof. The loops or openings may in some embodiments be provided proximate one or more edges of the tarpaulin or sheet. In some embodiments, the one or more loops or openings may be reinforced with a grommet which may be formed of a resilient material such as rubber or a hard material such as plastic or metal. The loops or openings may be used to facilitate securing the tarpaulin to the ground, by, for example, passing a spike, tent peg, or other object through the loop or opening and into the ground. The loops or openings may also be used to facilitate transporting the tarpaulin by securing an apparatus including a handle to one or more of the loops or openings. The loops or openings may further be used to facilitate enclosing material within the tarpaulin by folding the tarpaulin about the material and securing one or more loops or openings in the tarp to one or more other loops or openings in the tarp with a device passed through the loops or openings.

An embodiment of an apparatus, generally referenced at 10, for securing a tarp to the ground or for facilitating transportation of a tarp is illustrated in FIG. 1. The apparatus 10 includes a body 20. A device 16 is secured to the body 20 by a connecting member 18. As shown, the device 16 is configured to secure the apparatus 10 to the ground. A handle 12 may be secured to an end of the body. A joining device 22 is secured to another end of the body 20. The joining device 22 is configured to removably join the apparatus to an object.

The body 20 of the apparatus may comprise a strip of fabric. In some embodiments the fabric may comprise a high strength fabric material, for example nylon webbing. In other embodiments, the body 20 may comprise a flexible or elastic material, such as rubber. In other embodiments, the body 20 may comprise a section of rope or wire. The material or materials of construction for the body 20, or of any other parts of embodiments of the apparatus 10 described herein, may be selected from any appropriate material or materials, and embodiments of the apparatus 10 are not limited to being constructed from any particular material or materials unless explicitly set forth in the claims.

Device 16, which is configured to secure the apparatus to the ground, may comprise a spike or stake. The spike may be tapered as illustrated in FIG. 1 or may be of a substantially constant width along a length thereof. The connecting member 18 may pass through an orifice or loop provided on either a side or on an upper portion of the device 16 to secure the connecting member to the device 16. The connecting member 18 may comprise a strip of a fabric material, for example, nylon webbing, as illustrated in FIG. 1, or in other embodiments may comprise, for example, a rope, a cable, or a chain. The connecting member 18 may be secured to the device 16 by passing an end portion of the connecting member through an orifice formed in the device 16 and folding the end portion back upon another section of the connecting member 18. The folded end portion of the connecting member 18 is joined to the second portion by, for example, tying, plastic welding, stitching, sewing, or any other suitable method. An end of the connecting member 18 displaced along a length thereof from the device 16 may be coupled to the body 20 by any method known in the art, for example, by tying, plastic welding, stitching, or sewing. In other embodiments, one or both of the connecting member 18 and the body 20 may be provided with a hole or a loop through which a spike (which may be otherwise unsecured to the apparatus 10) may be inserted to secure the apparatus 10 to a surface such as the ground.

The handle 12 may comprise a tubular handle, for example, an injection molded plastic tubular handle, although any suitable handle constructed of any suitable material(s) may be utilized in various embodiments. For example, the handle 12 may comprise a solid handle including a loop or orifice for connecting to the body 20. The handle 12 may be connected to the body 20 by passing a loop 14 secured to the body 20, or consisting part of the body 20, through the inside of the hollow handle 12, or through an orifice or loop that may be present in other embodiments of the handle 12. As mentioned, the loop 14 may comprise an integral extension of the body 20 secured at an end thereof to the body by for example, stitching as illustrated in FIG. 1, or by any other method known in the art, for example, by sewing, tying, or plastic welding. In other embodiments, the loop 14 may be distinct from the body 20 and joined to the body 20 by a ring, loop, or other connector.

The joining device 22 may be secured to a portion of the body 20, for example, as illustrated in FIG. 1, to an end portion opposite to a portion of the body to which the handle 12 is secured. The joining device 22 may be secured to the body by passing an end of the body through an orifice in the joining device, folding the end of the body back on itself, and securing the end of the body to another portion of the body by a method such as sewing, stitching, plastic welding, tying, or other methods known in the art. In some embodiments, an intermediate ring or other connection device may be provided to secure the joining device 22 to the body 20. In some embodiments, the joining device 22 may include a metal loop with a spring loaded or screwed gate 24. In particular, the joining device may comprise a carabiner. The gate 24 may include a spring to push the gate 24 into a closed position against the loop forming the remainder of the carabiner such that it closes and may retain a loop or ring of material placed within the loop of the carabiner until the gate is pushed back into an open position to release the loop or ring of material. In other embodiments, the joining device 22 may comprise, for example, a hook or a screw and nut, or any other device capable of securing a loop or a ring of material to the body of the apparatus 10.

Figure 2:
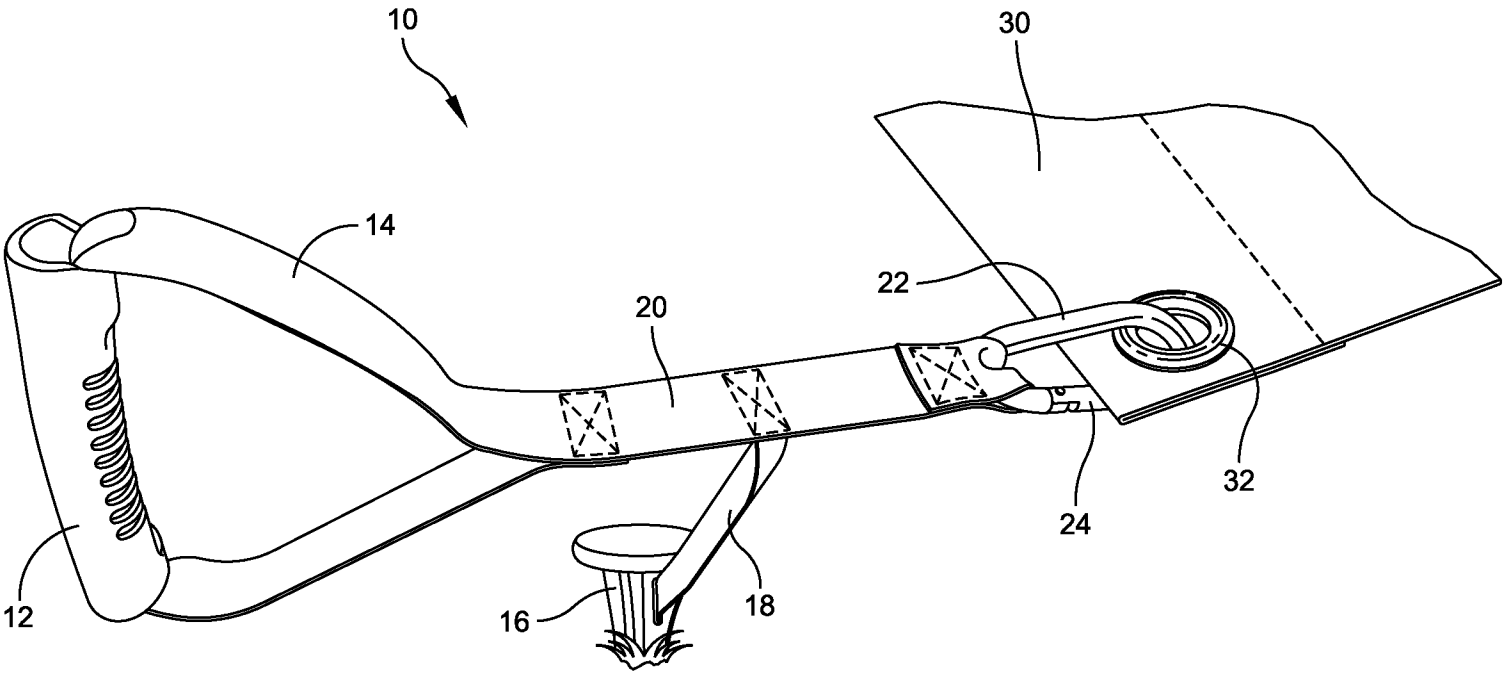
FIG. 2 is a perspective view of the apparatus shown in FIG. 1 in use securing a portion of a tarp to a surface.

In some embodiments, the apparatus 10 may be utilized to secure a tarp or other sheet to a surface, such as the ground, as illustrated in FIG. 2. A tarp 30 may be provided with a grommet reinforced hole 32 proximate an edge thereof. The tarp 30 may comprise multiple grommet reinforced holes 32 along one or more edges or corners thereof. In some embodiments, the tarp or sheet 30 may include loops, for example, fabric loops in place or in addition to the reinforced holes 32, that could perform a similar function as the reinforced holes 32 as described herein.

The joining device may be clipped onto the tarp 30 by passing an end of the joining device 22 through the hole 32. In some embodiments, a gate 24 of the joining device may close once the joining device is clipped on to the tarp to facilitate retention of the joining device 22 on the tarp 30. Once the joining device 22 is clipped into the hole 32 or loop of the tarp 30, a user may pull on the handle 12 to pull the tarp into a desired position or direction. Once in a desired position, the user may embed the spike 16 into the ground to hold the apparatus 10, and the portion of the tarp attached thereto, in place. Additional apparatus 10 may be used to position other portions of the tarp 30 in desired locations and/or apply tension to previously positioned portions of the tarp.

Figure 5:
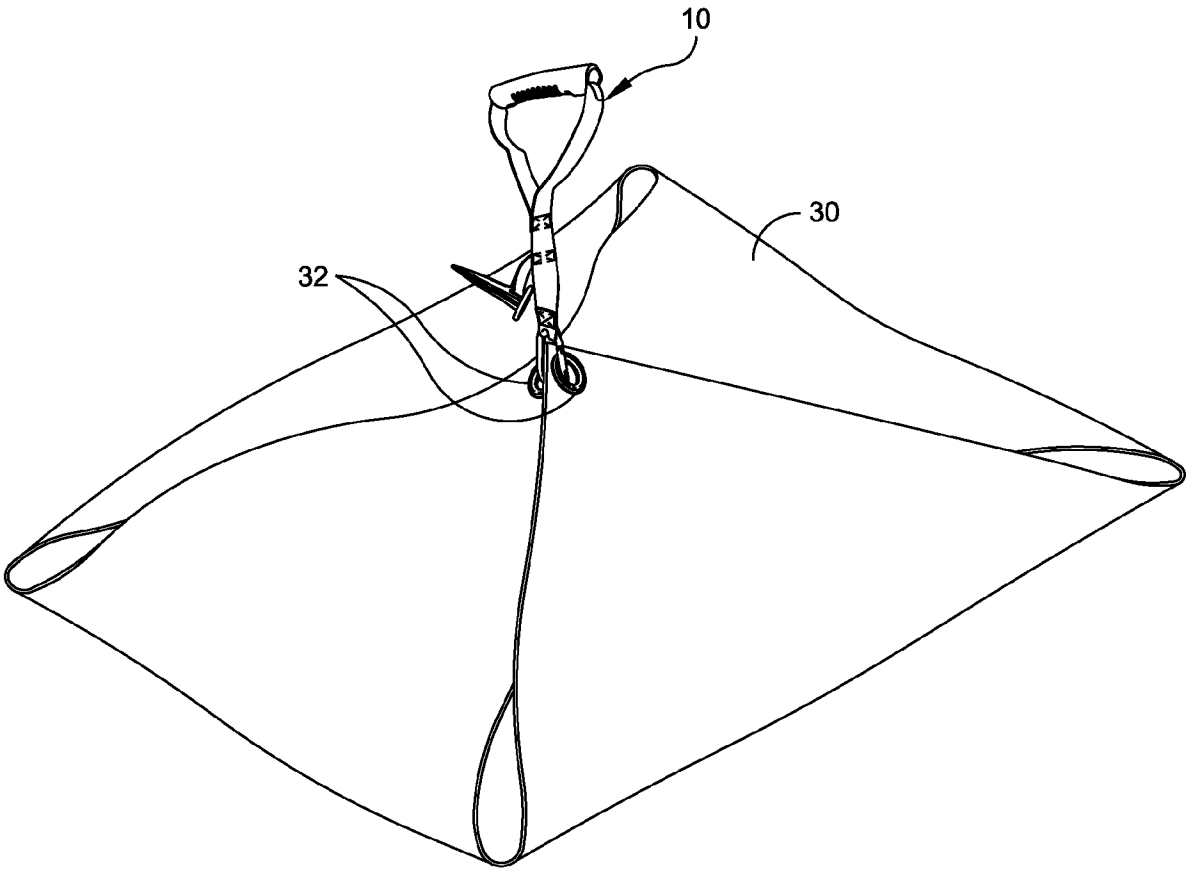
FIG. 5 is a perspective view of the apparatus shown in FIG. 1 in use securing a tarp into a folded configuration.

The user then may use the tarp for a desired purpose, for example to collect leaves, yard waste, or other debris thereupon. If it is desired to then move the tarp to, for example, a disposal area for the leaves, yard waste, or other debris, the user may disengage the spike or spikes 16 from the ground and pull on the handle 12 of one or more of the apparatus 10 attached to the tarp to drag the tarp to a desired location. Pulling on the handle can also disengage the spike from the ground if desired. In some embodiments, a user may secure one or more of the joining devices 22 of one or more of the apparatus to multiple of the reinforced holes 32 or loops in the tarp (FIG. 5) to form a pocket in the tarp to at least partially enclose the leaves, yard, waste, or other debris in the tarp, thus facilitating the retention of the material in the tarp during transport.

Figure 3:
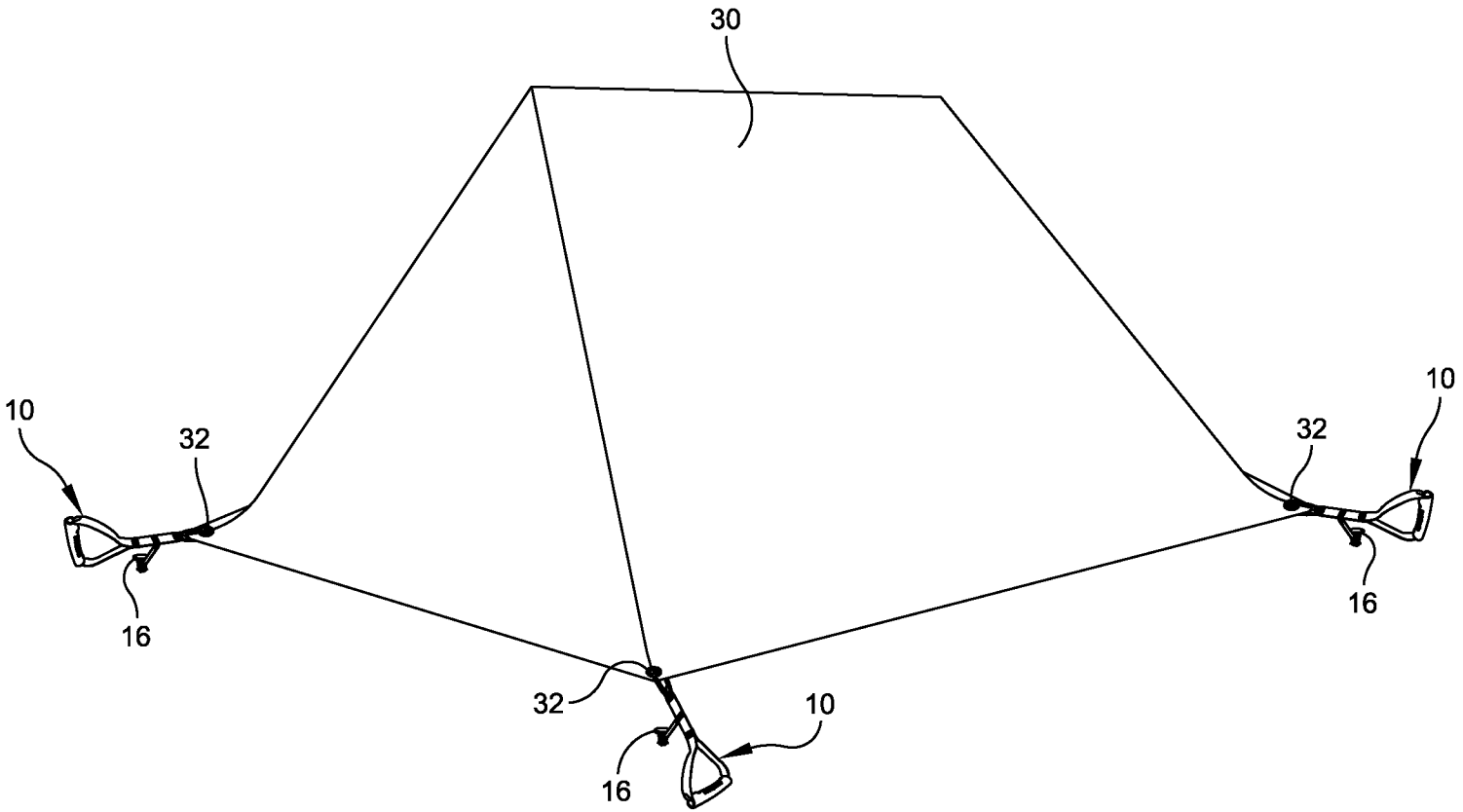
FIG. 3 is a perspective view of several of the apparatus shown in FIG. 1 in use securing a tent to a surface.

In another embodiment, illustrated in FIG. 3, a tarp or other sheet of material 30 may be used to form a tent. One or more apparatus 10 could be attached by the joining devices 22 thereof to one or more reinforced holes 32 or loops on one or more edges of the tarp 30. The apparatus 10 could then be pulled by the handles 12 to tighten the tarp material and the spikes 16 could be embedded in the ground to hold the one or more edges of the tent in place. In a similar manner, one or more apparatus 10 may be utilized to hold a tarp in place over an item which one may desire to protect from the elements, such as firewood, or a vehicle which one would desire to protect from wind, rain, snow, and/or airborne debris.

Various embodiments of the apparatus 10 for securing a tent or for holding a tarp in place over an item may differ from that illustrated in FIG. 3. For example, the body sections 20 of the apparatus 10 may comprise any of a strip of fabric, nylon webbing, a section of cable or rope, or an elastic or flexible material such as rubber. The body may include a connecting member 18 to secure a spike or stake 16 to the body 20 or may comprise one or more holes or openings through which a spike or stake (which may be unconnected to the body) may be driven. The connecting member 18 may comprise one or more holes or openings through which a spike or stake (which may be unconnected to the connecting member 18) may be driven. The connecting member 18 may comprise any of a strip of fabric, nylon webbing, a section of cable or rope, or an elastic or flexible material such as rubber. The spike or stake 16 may be tapered or non-tapered and may be provided with an orifice for securing a connecting member 18 on side portions or upper portions thereof. The joining device 22 may comprise a hook or a loop with a spring loaded gate 24 or another closing mechanism, such as a screw and nut.

Figure 4:
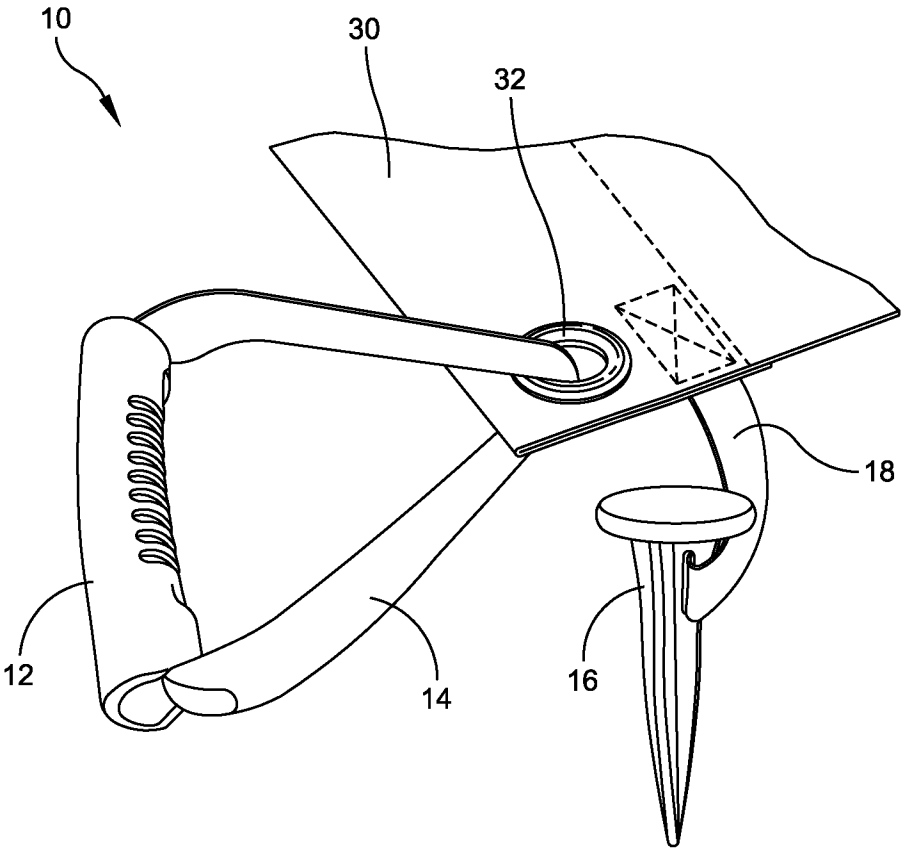
FIG. 4 is a perspective view of an apparatus of another embodiment of the present disclosure.

In a further embodiment, illustrated in FIG. 4, a tarp or tent may be provided with a tarp securing/pulling apparatus incorporated into an edge and/or corner portion or thereof. For example, as illustrated, one or more edges of a tarp 30 could include one or more spikes 16 attached thereto by one or more connecting members 18 and/or one or more handles 12 attached thereto by one or more loops 14. The handle 12 may be secured to the tarp 32 by a loop 14 passing through an opening 32 in the tarp. In some embodiments, the material of the loop 14 may be held in the form of a loop by a connector, for example, a button, clip, hook, or other fastener, that may be disengaged to allow the handle 12 to be removed from the tarp 30. In some embodiments, a loop 14 or a length of fabric, rope, cord, or other connecting structure may secure the handle directly to a portion of the tarp 30, for example, to an edge portion thereof by stitching, sewing, plastic welding, tying, or other methods known in the art.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. An apparatus comprising:

a body having a first end and a second end;

a handle coupled to the body at the first end of the body;

a joining device coupled to the body at the second end of the body, the joining device configured to removably join the apparatus to an object;

a securing device configured to secure the apparatus to the ground; and a connecting member having a first end and a second end, the securing device coupled to the connecting member at the first end of the connecting member, the connecting member coupled at the second end of the connecting member to the body at a position on the body between the first end of the body and the second end of the body.

2. The apparatus of claim 1, wherein the securing device comprises a spike.

3. The apparatus of claim 1, wherein the connecting member comprises a length of fabric.

4. The apparatus of claim 3, wherein the length of fabric comprises nylon webbing.

5. The apparatus of claim 1, wherein the joining device comprises a carabiner.

6. The apparatus of claim 1, wherein the body comprises a length of fabric.

7. The apparatus of claim 6, wherein the length of fabric comprises nylon webbing.

8. The apparatus of claim 6, wherein the handle is mechanically coupled to the body by a portion of the length of fabric passed through an orifice in the handle.

9. The apparatus of claim 8, wherein the portion of the length of fabric comprises a loop of material.

10. The apparatus of claim 6, wherein the joining device is configured to removably join the apparatus to the object by passing through one of a loop and an opening in the object.

11. The apparatus of claim 1, wherein the securing device is configured to be removed from the ground when the handle is lifted.

12. A kit comprising:

a sheet including at least one of a loop and an opening; and an apparatus including a body having a first end and a second end;

a handle coupled to the body at the first end of the body; and a joining device coupled to the body at the second end of the body, the joining device configured to removably join the apparatus to the sheet;

a securing device configured to secure the apparatus to the ground; and a connecting member having a first end and a second end, the securing device coupled to the connecting member at the first end of the connecting member, the connecting member coupled at the second end of the connecting member to the body at a position on the body between the first end of the body and the second end of the body.

13. The kit of claim 12, wherein the sheet comprises a tarpaulin.

14. The kit of claim 13, wherein the opening comprises a grommet.

15. The kit of claim 13, wherein the tarpaulin is configured to form a tent.

16. A method comprising:

providing a tarpaulin including one of a loop and an opening;

providing an apparatus including a body having a first end and a second end;

a securing device configured to secure the apparatus to the ground;

a connecting member having a first end and a second end, the securing device coupled to the connecting member at the first end of the connecting member, the connecting member coupled at the second end of the connecting member to the body at a position on the body between the first end of the body and the second end of the body;

a handle coupled to the body at the first end of the body; and a joining device coupled to the body at the second end of the body, the joining device configured to removably join the apparatus to the tarpaulin;

passing a portion of the joining device through the at least one of the loop and the opening;

securing the joining device in the at least one of the loop and the opening;

embedding a portion of the securing device in the ground; and placing an amount of debris on a surface of the tarpaulin.

17. The method of claim 16, further comprising transporting the debris placed on the tarpaulin by applying a force to the handle.

18. The method of claim 17, further comprising:

passing the portion of the joining device through at least one of a second loop and a second opening in the tarpaulin; and securing the portion of the joining device through the at least one of the second loop and the second opening prior to transporting the debris placed on the tarpaulin.

19. The method of claim 16, further comprising configuring the tarpaulin into a portion of a tent.

20. A method of moving yard waste comprising:

staking a tarp having a sheet and at least one opening in the sheet with an apparatus, the apparatus including:

a body having a first end and a second end;

a securing device configured to secure the apparatus to the ground;

a connecting member having a first end and a second end, the securing device coupled to the connecting member at the first end of the connecting member, the connecting member coupled at the second end of the connecting member to the body at a position on the body between the first end of the body and the second end of the body;

a handle coupled to the body at the first end of the body; and a joining device coupled to the body at the second end of the body, the joining device configured to removably join the apparatus to the tarpaulin;

depositing yard waste on the tarp; and moving the tarp with the apparatus.

21. The method of claim 20, wherein the tarp comprises a plurality of the at least one opening and the method further comprises coupling the joining device to the plurality of the at least one opening subsequent to depositing the yard waste on the tarp.

22. The method of claim 21, wherein coupling the joining device to the plurality of the at least one opening comprises facilitating retaining the yard waste on the tarp by forming a pocket from the tarp within which the yard waste is enclosed.

* * * * *